US009666964B2

(12) United States Patent
Tsai et al.

(10) Patent No.: US 9,666,964 B2
(45) Date of Patent: May 30, 2017

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Long Fei Chen, New Taipei (TW); Rui Su, New Taipei (TW); Chien-Tsung Chuang, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/233,957

(22) Filed: Aug. 11, 2016

(65) Prior Publication Data

US 2017/0047674 A1 Feb. 16, 2017

(30) Foreign Application Priority Data

Aug. 13, 2015 (CN) ..... 2015 1 0495269

(51) Int. Cl.

| | |
|---|---|
| ***H01R 12/00*** | (2006.01) |
| ***H01R 12/71*** | (2011.01) |
| ***H01R 24/62*** | (2011.01) |
| ***H01R 13/6585*** | (2011.01) |
| *H01R 107/00* | (2006.01) |

(52) U.S. Cl.

CPC ..... *H01R 12/716* (2013.01); *H01R 13/6585* (2013.01); *H01R 24/62* (2013.01); *H01R 2107/00* (2013.01)

(58) Field of Classification Search

CPC ..... H01R 12/716; H01R 2107/00; H01R 13/6598; H01R 13/6585; H01R 13/6275; H01R 24/62; H01R 24/60; H01R 9/032; H01R 12/727; H01R 4/027

See application file for complete search history.

(56) References Cited

U.S. PATENT DOCUMENTS

| | | | | |
|---|---|---|---|---|
| 7,462,071 | B1 * | 12/2008 | Wu | H01R 9/032 439/497 |
| 7,758,374 | B2 * | 7/2010 | Yu | H01R 4/027 439/493 |
| 9,147,979 | B1 * | 9/2015 | Chung | H01R 12/727 |
| 9,502,837 | B2 * | 11/2016 | Kao | H01R 24/60 |

(Continued)

*Primary Examiner* — Jean F Duverne

(74) *Attorney, Agent, or Firm* — Winston Hsu; Scott Margo

(57) ABSTRACT

An electrical receptacle connector includes an insulator and a blanking contact set. The insulator includes a tongue portion and an insulator rear end. The blanking contact set includes a plurality of blanking contacts. At least one of the blanking contacts includes a connecting portion, a contacting portion, and a soldering portion. The connecting portion is combined with the insulator. The contacting portion extends from the connecting portion toward the tongue portion and stretches out of a first surface of the tongue portion. The soldering portion extends from the connecting portion toward the insulator rear end and stretches out of the insulator rear end. A central axis of the contacting portion is spaced from a central axis of the soldering portion by an offset. The connecting portion connects the contacting portion and the soldering portion.

12 Claims, 10 Drawing Sheets

(56) References Cited

U.S. PATENT DOCUMENTS

| | | | | |
|---|---|---|---|---|
| 2005/0186830 | A1* | 8/2005 | Wu | H01R 13/6275 439/358 |
| 2006/0121783 | A1* | 6/2006 | Wu | H01R 9/032 439/607.41 |
| 2010/0210124 | A1* | 8/2010 | Li | H01R 23/6873 439/108 |
| 2013/0130548 | A1* | 5/2013 | Wu | H01R 13/6598 439/607.01 |
| 2013/0130549 | A1* | 5/2013 | Wu | H01R 13/6598 439/607.01 |
| 2015/0244111 | A1* | 8/2015 | Ju | H01R 13/6585 439/607.05 |
| 2015/0244118 | A1* | 8/2015 | Lin | H01R 24/60 439/357 |

* cited by examiner

ELECTRICAL RECEPTACLE CONNECTOR

BACKGROUND OF THE INVENTION

1. Field of the Invention

The present invention relates to an electrical receptacle connector, and more particularly, to an electrical receptacle connector adapted for a Universal Serial Bus interface.

2. Description of the Prior Art

With the development of computer and peripheral equipment industry, a Universal Serial Bus (USB) interface has become one of important interfaces for communication and data transmission between computers and peripheral equipment. As technology advances, high speed transmission becomes a trend, and there is a need to develop an electrical connector with high speed transmission. Thus, a new specification of the Universal Serial Bus interface, i.e., Universal Serial Bus (USB) 3.0, is developed. However, when an electrical connector with specification in accordance with USB 3.0, is welded on a circuit board, two contact soldering portions may interfere with each other easily due to narrow pitches. Therefore, it becomes an important issue how to arrange contacts of an electrical connector in the industry.

SUMMARY OF THE INVENTION

The present invention provides an electrical receptacle connector adapted for a Universal Serial Bus (USB) interface and having an expanded arrangement of contacts for solving above drawbacks.

In order to achieve the aforementioned objective, an electrical receptacle connector adapted for a circuit board includes a shell, an insulator, a conductive structure, a shielding member, and a first blanking contact set. The insulator includes a tongue portion and an insulator rear end. The tongue portion is disposed in the shell and includes a first surface and a second surface. The conductive structure is disposed on the insulator. The shielding member is disposed in the tongue portion. The first blanking contact set includes a plurality of first blanking contacts. At least one of the plurality of first blanking contacts includes a first connecting portion, a first contacting portion, and a first soldering portion. The first connecting portion is combined with the insulator. The first contacting portion extends from the connecting portion toward the tongue portion and stretching out of the first surface. The first soldering portion extends from the connecting portion toward the insulator rear end and stretching out of the insulator rear end. A central axis of the first contacting portion is spaced from a central axis of the first soldering portion by a first offset, and the first connecting portion connects the first contacting portion and the first soldering portion.

In summary, the central axis of the first contacting portion of the present invention is spaced from the central axis of the first soldering portion by the first offset, and the first connecting portion connects the first contacting portion and the first soldering portion. Accordingly, a pitch between the two adjacent first contacting portions is not equal to a pitch between the two adjacent first soldering portions. Therefore, the pitch between the two adjacent first contacting portions can be designed for generally usage of the electrical receptacle connector in accordance with a specification of USB 3.0, and the pitch between the two adjacent first soldering portions can be adjusted according to welding positions on the circuit board. As a result, it achieves better utilization of space, prevents interference between the first soldering portions and reduces cost of manufacture.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
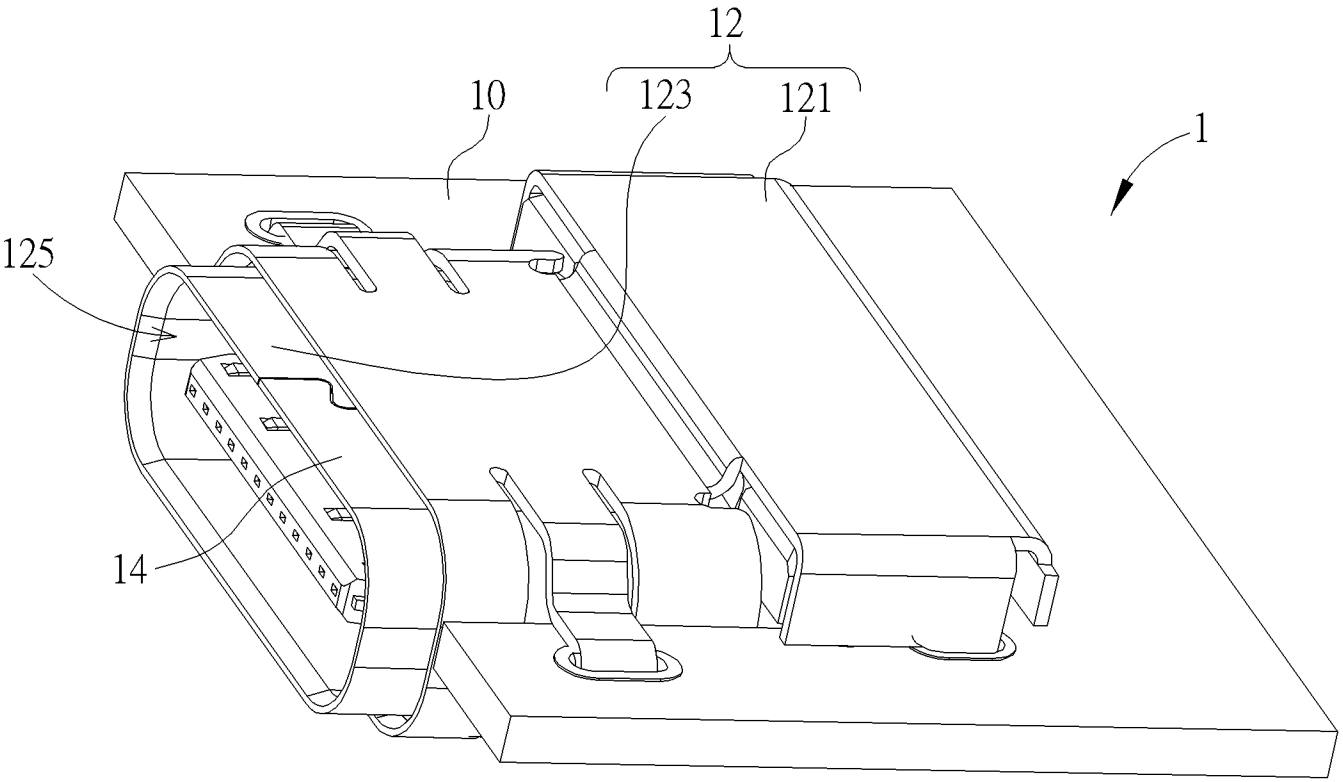
FIG. 1 is a schematic diagram of an electrical receptacle connector according to a first embodiment of the present invention.
Figure 2:
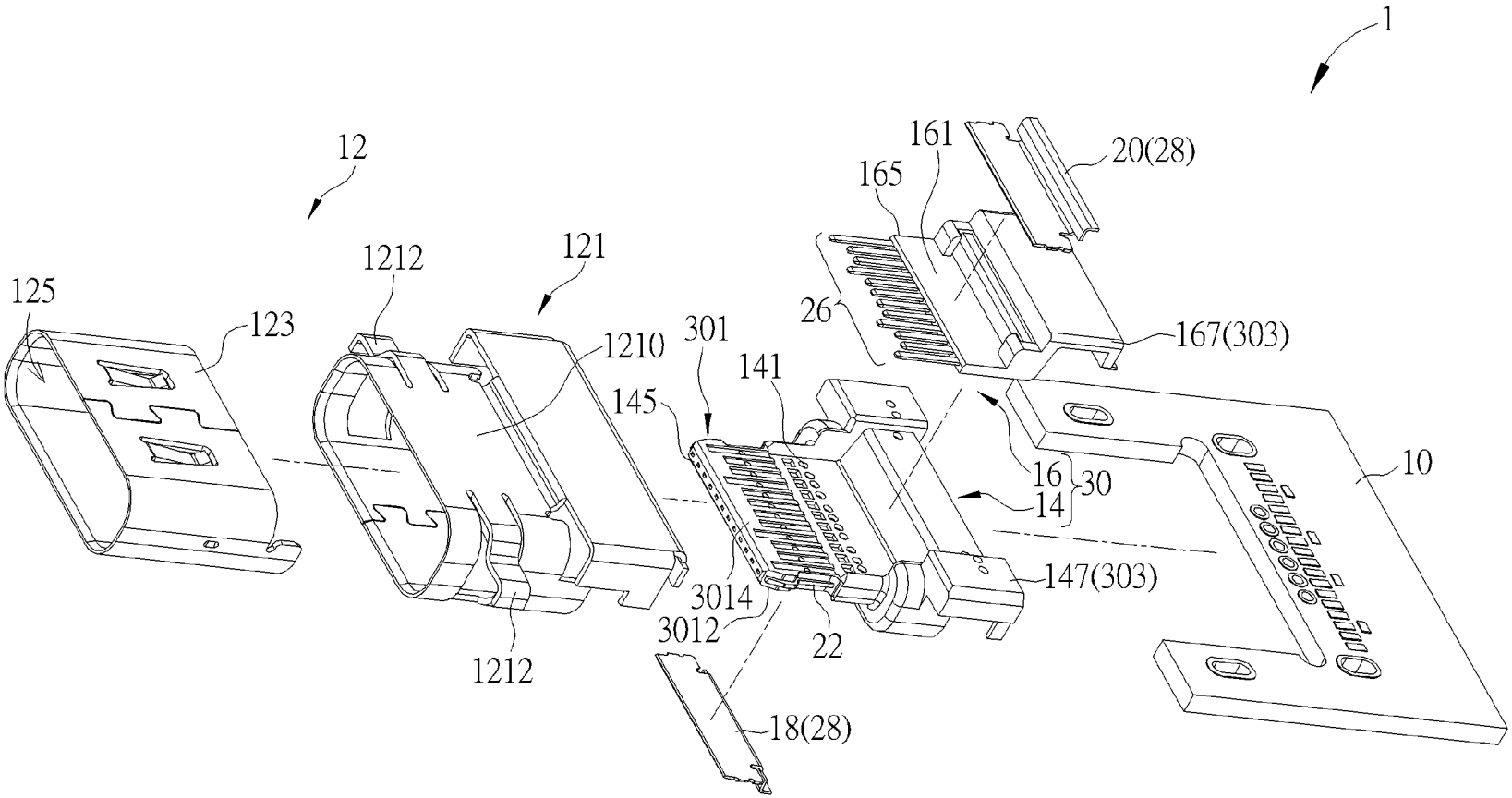
FIG. 2 and FIG. 3 are exploded diagrams of the electrical receptacle connector at different views according to the first embodiment of the present invention.
Figure 3:
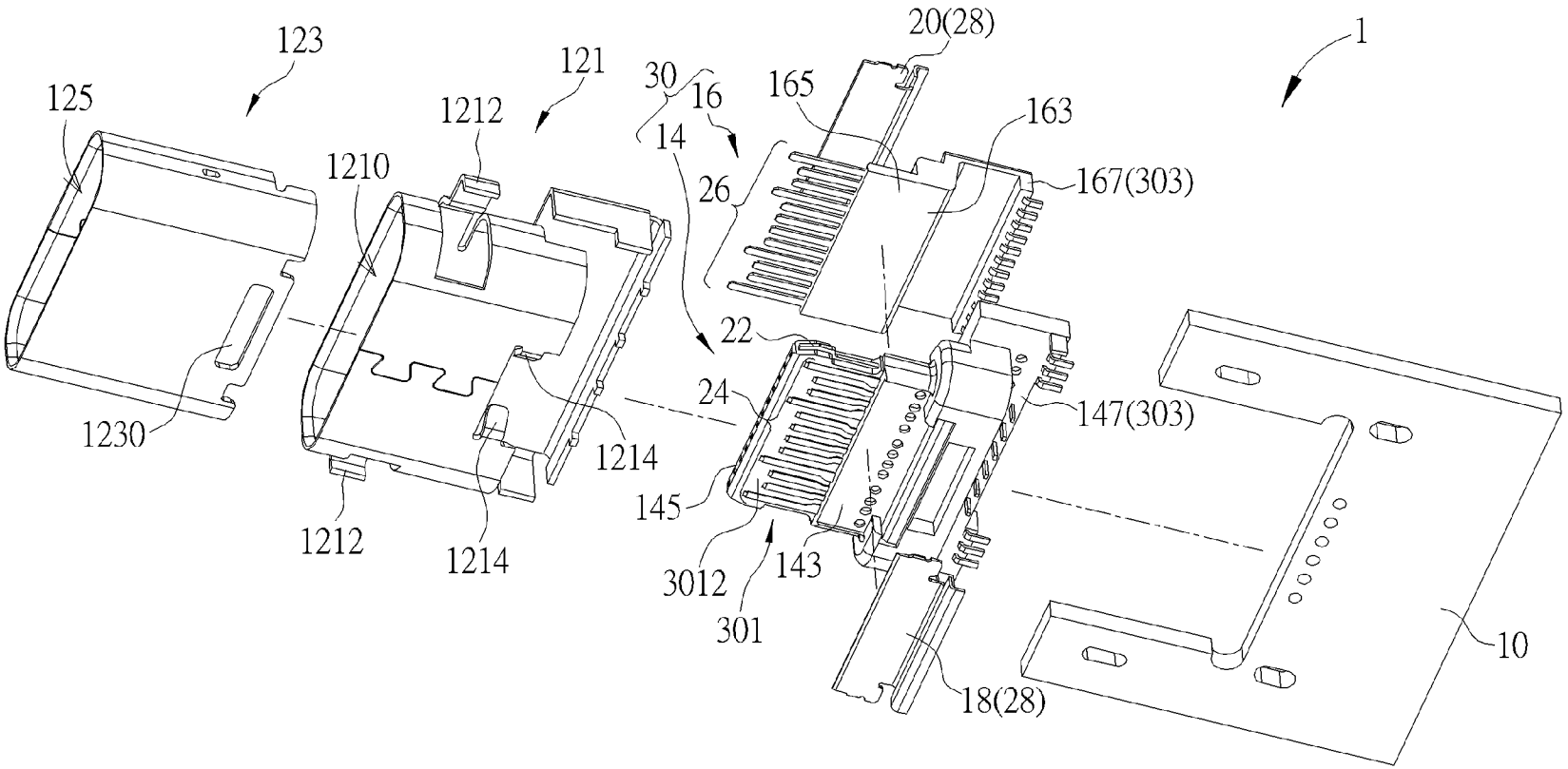

Please refer to FIG. 1 to FIG. 3. FIG. 1 is a schematic diagram of an electrical receptacle connector 1 according to a first embodiment of the present invention. FIG. 2 and FIG. 3 are exploded diagrams of the electrical receptacle connector 1 at different views according to the first embodiment of the present invention. As shown in FIG. 1 to FIG. 3, the electrical receptacle connector 1 is disposed on a circuit board 10 and includes a shell 12, a conductive structure 28, an insulator 30, a shielding member 22, a first blanking contact set 24, and a second blanking contact set 26. The shell 12 includes a first shell 121 and a second shell 123. The first shell 121 is fixed on the circuit board 10. The second shell 123 is fixed on the first shell 121. An accommodating space 125 is enclosed by the second shell 123 for receiving the insulator 30. The first shell 121 includes a shell body 1210, two welding legs 1212, and two engaging protrusions 1214. The two welding legs 1212 protrude from the shell body 1210 and embed into the circuit board 10. The two engaging protrusions 1214 are formed on the shell body 120. An engaging slot 1230 is formed on the second shell 123 and corresponding to the two engaging protrusions 1214. The two engaging protrusions 1214 engage with the engaging slot 1230, so as to fix the first shell 121 onto the second shell 123 in a riveting manner. The insulator 30 includes a tongue portion 301 and an insulator rear end 303. The tongue portion 301 is disposed in the shell 12 and includes a first surface 3012 and a second surface 3014. The conductive structure 28 is disposed on the insulator 30. The shielding member 22 is disposed in the tongue portion 301 of the insulator 30. In this embodiment, the insulator 30 includes a first insulator 14 and a second insulator 16 assembled with the first insulator 14, and the conductive structure 28 includes a first conductive member 18 and a second conductive member 20.

Furthermore, the first insulator 14 includes a first upper surface 141, a first lower surface 143, a first front end 145, and a first rear end 147. The second insulator 16 includes a second upper surface 161, a second lower surface 163, a second front end 165, and a second rear end 167. The tongue portion 301 protrudes from the first insulator 14. When the second insulator 16 is installed on the first insulator 14, the first upper surface 141 abuts against the second lower surface 163, and the first rear end 147 and the second rear end 167 define the insulator rear end 303 cooperatively. The first conductive member 18 is disposed on the first lower surface 143. The second conductive member 20 is disposed on the second upper surface 161. The shielding member 22 is disposed in the tongue portion 301.

Figure 4:
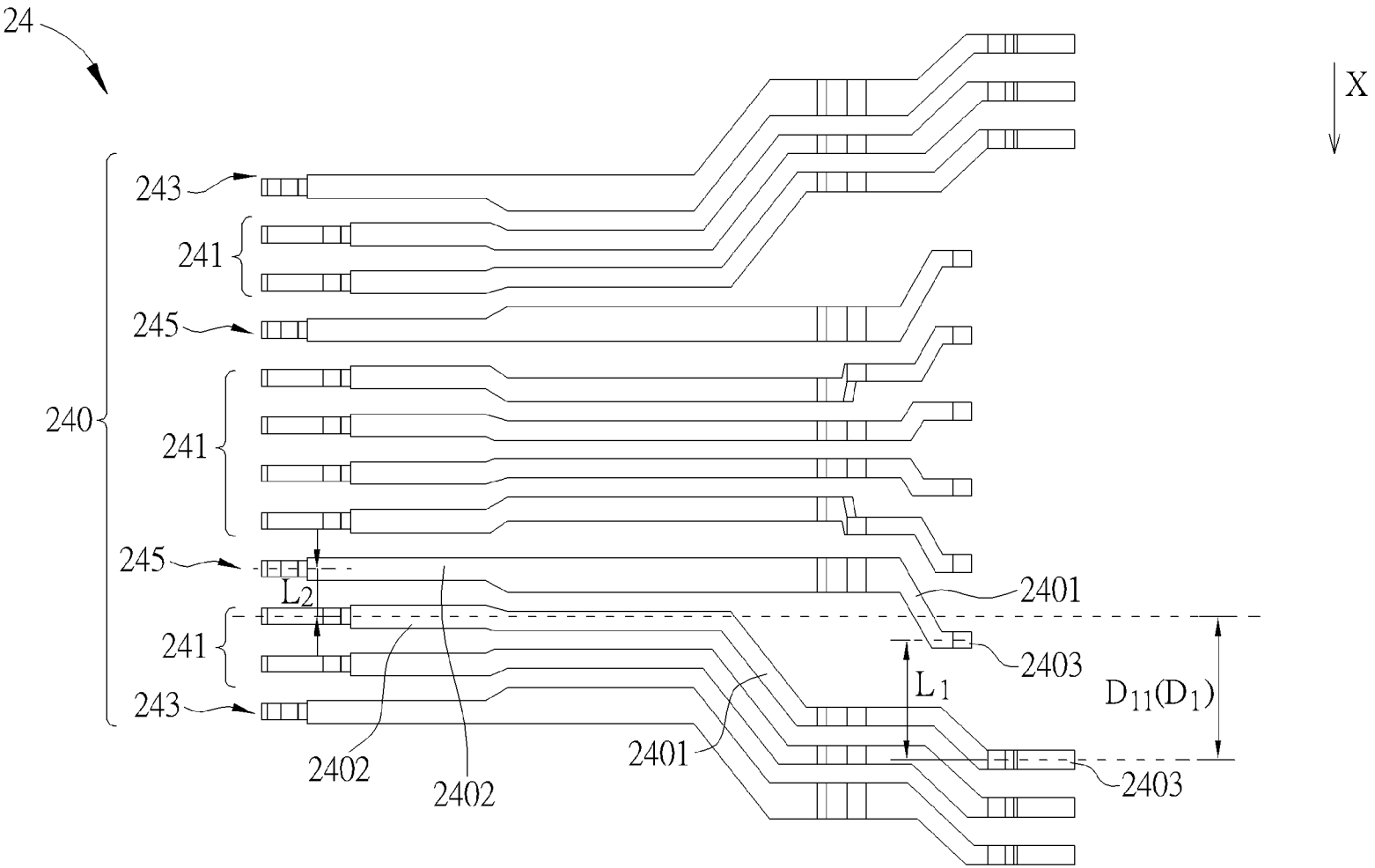
FIG. 4 is a top view diagram of a first blanking contact set of the electrical receptacle connector according to the first embodiment of the present invention.
Figure 5:
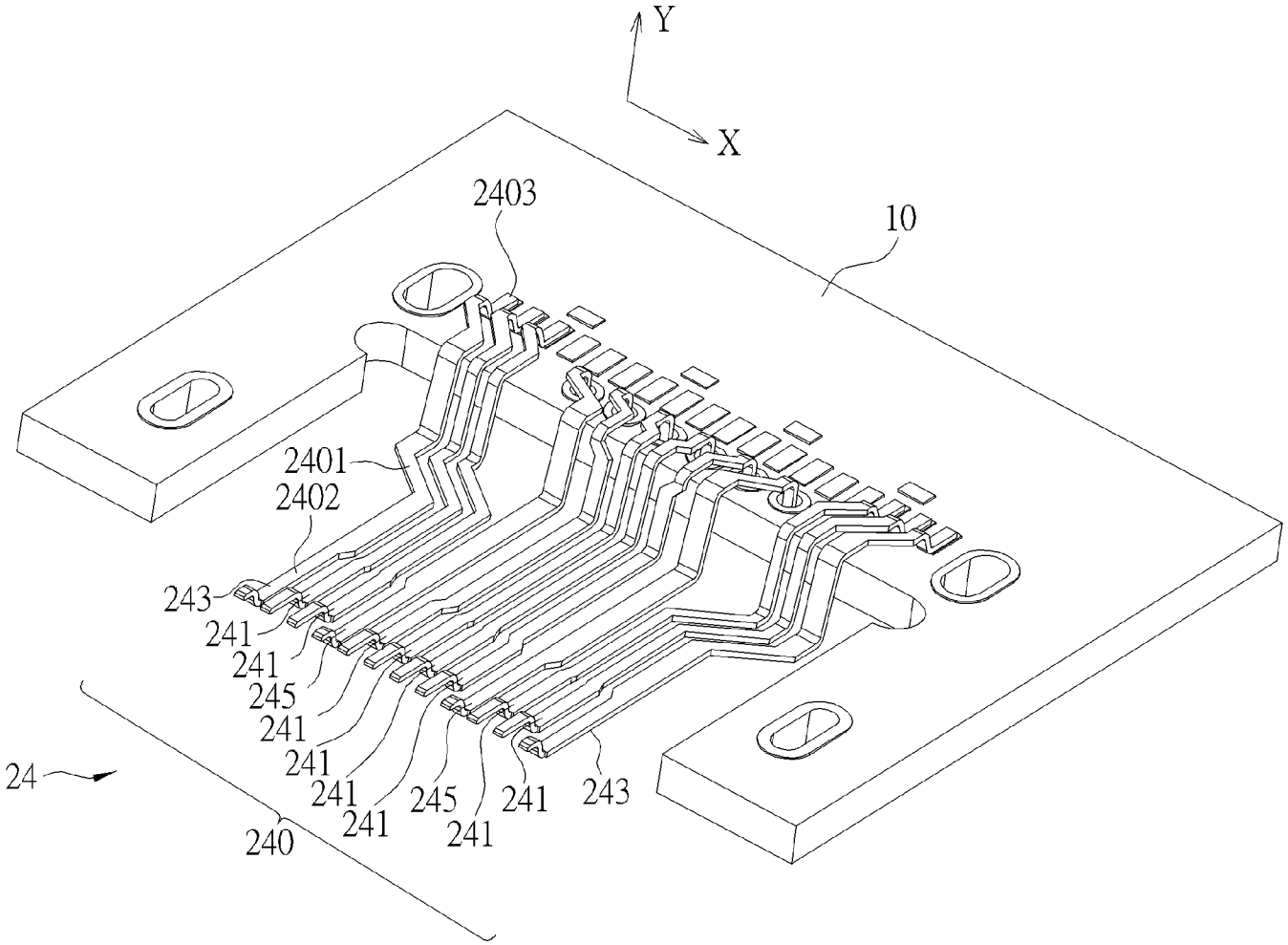
FIG. 5 is a diagram illustrating the first blanking contact set disposed on a circuit board according to the first embodiment of the present invention.

Please refer to FIG. 2 to FIG. 5. FIG. 4 is a top view diagram of the first blanking contact set 24 of the electrical receptacle connector 1 according to the first embodiment of the present invention. FIG. 5 is a diagram illustrating the first blanking contact set 24 disposed on the circuit board 10 according to the first embodiment of the present invention. As shown in FIG. 2 to FIG. 5, the first blanking contact set 24 is disposed on the first insulator 14. The first blanking contact set 24 includes a plurality of first blanking contacts 240 spaced from one another and arranged in parallel in a plane direction X. At least one of the plurality of first blanking contacts 240 includes a first connecting portion 2401, a first contacting portion 2402, and a first soldering portion 2403. The first connecting portion 2401 is combined with the first insulator 14 of the insulator 30. The first contacting portion 2402 extends from the first connecting portion 2401 toward the first front end 145 and stretches out of the first front end 145, i.e., the first contacting portion 2402 protrudes from the first connecting portion 2401 toward the tongue portion 301 and stretches out of the first surface 3012. The first soldering portion 2403 extends from the first connecting portion 2401 toward the first rear end 147 and stretches out of the first rear end 147, i.e., the first soldering portion 2403 extends from the first connecting portion 2401 toward the insulator rear end 303 and stretches out of the insulator rear end 303. The first connecting portion 2401 connects the first contacting portion 2402 and the first soldering portion 2403. In this embodiment, the first blanking contact set 24 includes at least one first signal contact 241, at least one first grounding contact 243, and at least one first power contact 245.

As shown in FIG. 4, a central axis of the first contacting portion 2402 is spaced from a central axis of the first soldering portion 2403 by a first offset D1. The first offset D1 can be decomposed in a first horizontal offset D11 along the plane direction X. Since the central axis of the first contacting portion 2402 is spaced from the central axis of the first soldering portion 2403 by the first horizontal offset D11, a first pitch L1 between the two adjacent first contacting portions 2402 is not equal to a second pitch L2 between the two adjacent first soldering portions 2403, so that the first blanking contact set 24 is formed in an expanded arrangement from the first front end 145 toward the first rear end 147 along the plane direction X.

Figure 6:
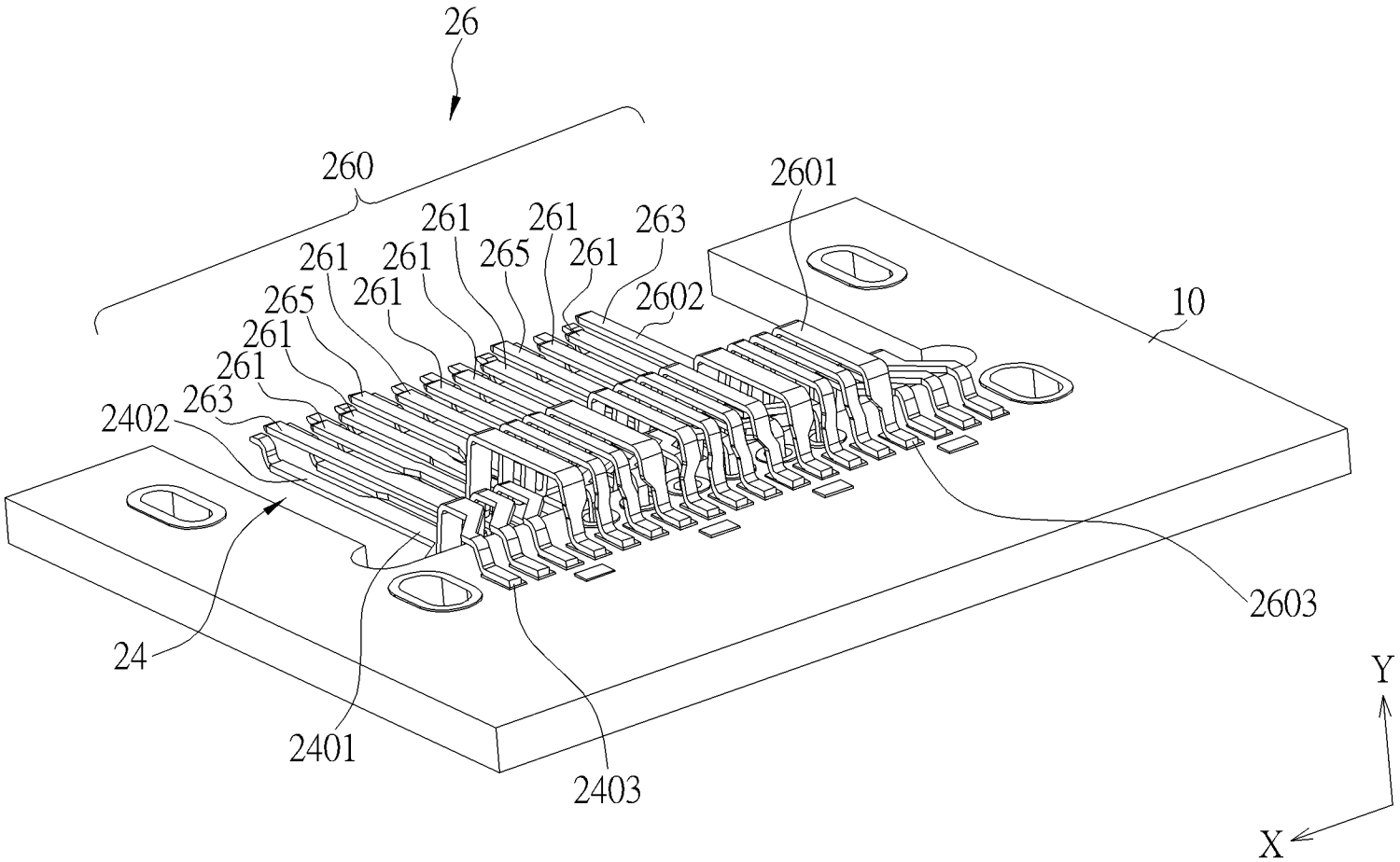
FIG. 6 is a diagram illustrating that the first blanking contact set and a second blanking contact set are disposed on the circuit board according to the first embodiment of the present invention.

Please refer to FIG. 2, FIG. 3, and FIG. 6. FIG. 6 is a diagram illustrating that the first blanking contact set 24 and the second blanking contact set 26 are disposed on the circuit board 10 according to the first embodiment of the present invention. As shown in FIG. 2, FIG. 3, and FIG. 6, the second blanking contact set 26 is disposed on the second insulator 16. The second blanking contact set 26 includes a plurality of second blanking contacts 260 spaced from one another. The plurality of second blanking contacts 260 are arranged in parallel and along the plane direction X. At least one of the plurality of second blanking contacts 260 includes a second connecting portion 2601, a second contacting portion 2602, and a second soldering portion 2603. The second connecting portion 2601 is combined with the second insulator 16 of the insulator 30. The second contacting portion 2602 extends from the second connecting portion 2601 toward the second front end 165 and stretches out of the second front end 165, i.e., the second contacting portion 2602 extends from the second connecting portion 2601 toward the tongue portion 301 and stretches out of the second surface 3014. The second soldering portion 2603 extends from the second connecting portion 2601 toward the second rear end 167, i.e., the insulator rear end 303, and stretches out of the second rear end 167. The second connecting portion 2601 connects the second contacting portion 2602 and the second soldering portion 2603. In this embodiment, the second blanking contact set 26 includes at least one signal contact 261, at least one second grounding contact 263, and at least one second power contact 265.

Furthermore, a central axis of the second contacting portion 2602 is spaced from a central axis of the second soldering portion 2603 by a second offset D2. However, different from the first blanking contact 240, the second offset D2 cannot be decomposed in a second horizontal offset along the plane direction X, i.e., the central axis of the second contacting portion 2602 coincides with the central axis of the second soldering portion 2603. In other words, a pitch between the two adjacent second soldering portions 2603 is equal to a pitch between the two adjacent second contacting portions 2602, as shown in FIG. 6. Structures of the second contacting portion 2602 and the second soldering portion 2603 of the second blanking contact set 26 are not limited to those illustrated in the figures in this embodiment. In another embodiment, the central axis of the second contacting portion 2602 also can be spaced from the central axis of the second soldering portion 2603 by the second horizontal offset along the plane direction X, so that the second blanking contact set 26 can be formed in an expanded arrangement. It depends on practical demands.

Figure 7:
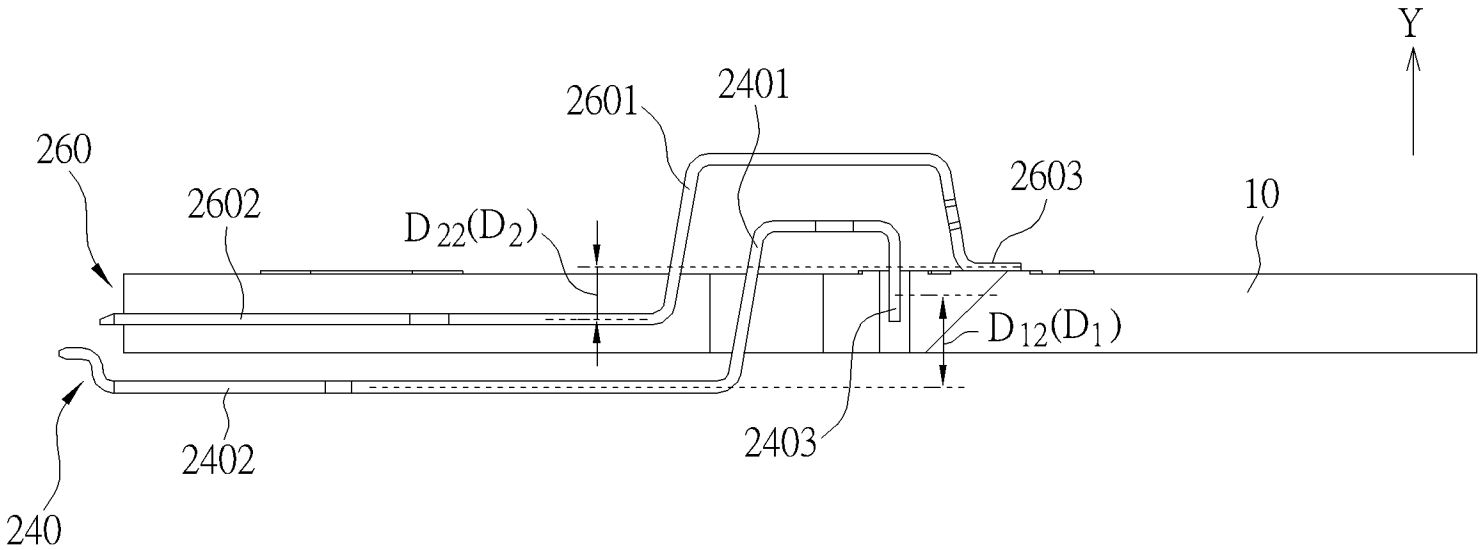
FIG. 7 is a sectional diagram of a first blanking contact, a second blanking contact, and the circuit board according to the first embodiment of the present invention.

Please refer to FIG. 4 and FIG. 7. FIG. 7 is a sectional diagram of the first blanking contact 240, the second blanking contact 260, and the circuit board 10 according to the first embodiment of the present invention. As shown in FIG. 4 and FIG. 7, the first offset D1 can be further decomposed in a first vertical offset D12. In addition to that the central axis of the first contacting portion 2402 of the first blanking contact 240 is spaced from the central axis of the first soldering portion 2403 by the first horizontal offset D11 along the plane direction X, as shown in FIG. 4, the central axis of the first contacting portion 2402 of the first blanking contact 240 is further spaced from the central axis of the first soldering portion 2403 by the first vertical offset D12 along an elevation direction Y perpendicular to the plane direction X, as shown in FIG. 7. In other words, there is an elevation difference, i.e., the first vertical offset D12, along the elevation direction Y between the first contacting portion 2402 and the first soldering portion 2403. In a practical application, the first connecting portion 2401 can be bent not only along the elevation direction Y but also along the plane direction X, so as to connect the first contacting portion 2402 and the first soldering portion 2403 spaced from each other by the first elevation difference.

Similarly, the second offset D2 can be further decomposed in a second vertical offset D22. The central axis of the second contacting portion 2602 is spaced from the central axis of the second soldering portion 2603 by the second vertical offset D22 along the elevation direction Y, as shown in FIG. 7. In other words, the central axis of the second contacting portion 2602 is spaced from the central axis of the second soldering portion 2603 by a second elevation difference, i.e., the second vertical offset D2, along the elevation direction Y. In other words, the second offset D2 between the central axis of the second contacting portion 2602 and the central axis of the second soldering portion 2603 can only be decomposed in the second vertical offset D22 along the elevation direction Y but cannot be decomposed in the second horizontal offset along the plane direction X. In a practical application, the second connecting portion 2601 can be bent along the elevation direction Y, so as to connect the second contacting portion 2602 and the second soldering portion 2603 spaced from each other by the second elevation difference.

In this embodiment, the electrical receptacle connector 1 can be an electrical receptacle connector with a Universal Serial Bus (USB) Type-C interface. Each of the first blanking contact set 24 and the second blanking contact set 26 can includes signal contacts, grounding contacts, power contacts satisfying specification of USB 3.0. Each of the first blanking contact set 24 and the second blanking contact set 26 can include at least two pairs of differential signal contacts. The at least two pairs of differential signal contacts of the first blanking contact set 24 is symmetrical to the at least two pairs of differential signal contacts of the second blanking contact set 26 about a front-rear direction of the electrical receptacle connector 1 and coincides with the at least two pairs of differential signal contacts of the second blanking contact set 26 after rotation by 180 degrees. Specifically, the first blanking contact set 24 includes a first grounding contact (GND), a first pair of differential signal contacts (RX1+, RX1−), a first power contact ($V_{BUS}$), an auxiliary signal contact (SBU2), a second pair of differential signal contacts (D−, D+), a positioning contact (CC2), a second power contact ($V_{BUS}$), a third pair of differential signal contacts (TX2−, TX2+), and a second grounding contact (GND) from left to right. The first pair of differential signal contact (RX1+, RX1−) and the third pair of differential signal contact (TX2−, TX2+) can perform signal transmission satisfying specification of USB 3.0 or USB 3.1. The second pair of differential signal contact (D−, D+) can perform signal transmission satisfying specification of USB 2.0. Each pitch between the first contacting portions 2402 of the first blanking contact set 24 is accordance with the specification of USB TYPE-C. The first soldering portions 2403 are connected to the first contacting portions 2402 by the first connecting portions 2401, so that a pitch between two soldering portions of the differential signal contact (RX1), the first power contact ($V_{BUS}$), the second pair of differential signal contacts (D−, D+), the positioning contact (CC2), the second power contact ($V_{BUS}$), and the differential signal contact (TX2−) is not equal to a pitch between the two corresponding contacting portions, which has a better space utilization. The first soldering portions 2403 of the first signal contacts 241, i.e., the soldering portions of the auxiliary signal contact (SBU2), the second pair of differential signal contacts (D−, D+), the positioning contact (CC2), are spaced from one another by the first pitch L1. The first contacting portions 2402 of the first signal contacts 241 are spaced from one another by the second pitch L2. The first pitch L1 is not equal to the second pitch L2. The second blanking contact set 26 includes a grounding contact (GND), a fourth pair differential signal contacts (TX1+, TX1−), a power contact ($V_{BUS}$), a positioning contact (CC1), a fifth pair of differential signal contacts (D+, D−), an auxiliary signal contact (SBU1), a power contact ($V_{BUS}$), a sixth pair of differential signal contacts (RX2−, RX2+), and a grounding contact (GND). The fourth pair of differential signal contacts (TX1+, TX1−) and the sixth pair of differential signal contacts (RX2−, RX2+) can perform signal transmission satisfying the specification of USB 3.0 or USB 3.1. The fifth pair of differential signal contact (D+, D−) can perform signal transmission satisfying the specification of USB 2.0. Each pitch between the second contacting portions 2602 of the second blanking contact set 26 is accordance with the specification of USB TYPE-C. Each pitch between the second soldering portions 2603 is equal to the corresponding pitch between the second contacting portions 2602.

It should be noticed that the first conductive member 18 and the second conductive member 20 can be two Electro Magnetic Interference (EMI) springs in accordance with the specification of USB 3.0. The shielding member 22 can be a shielding plate in accordance with the specification of USB 3.0. The two EMI springs, i.e., the first conductive member 18 and the second conductive member 20, are disposed on an upper side and a lower side of the insulator 30, respectively. The shielding plate, i.e., the shielding member 22, is enclosed by the insulator 30 and disposed between the first blanking contacts set 24 and the second blanking contact set 26.

Figure 8:
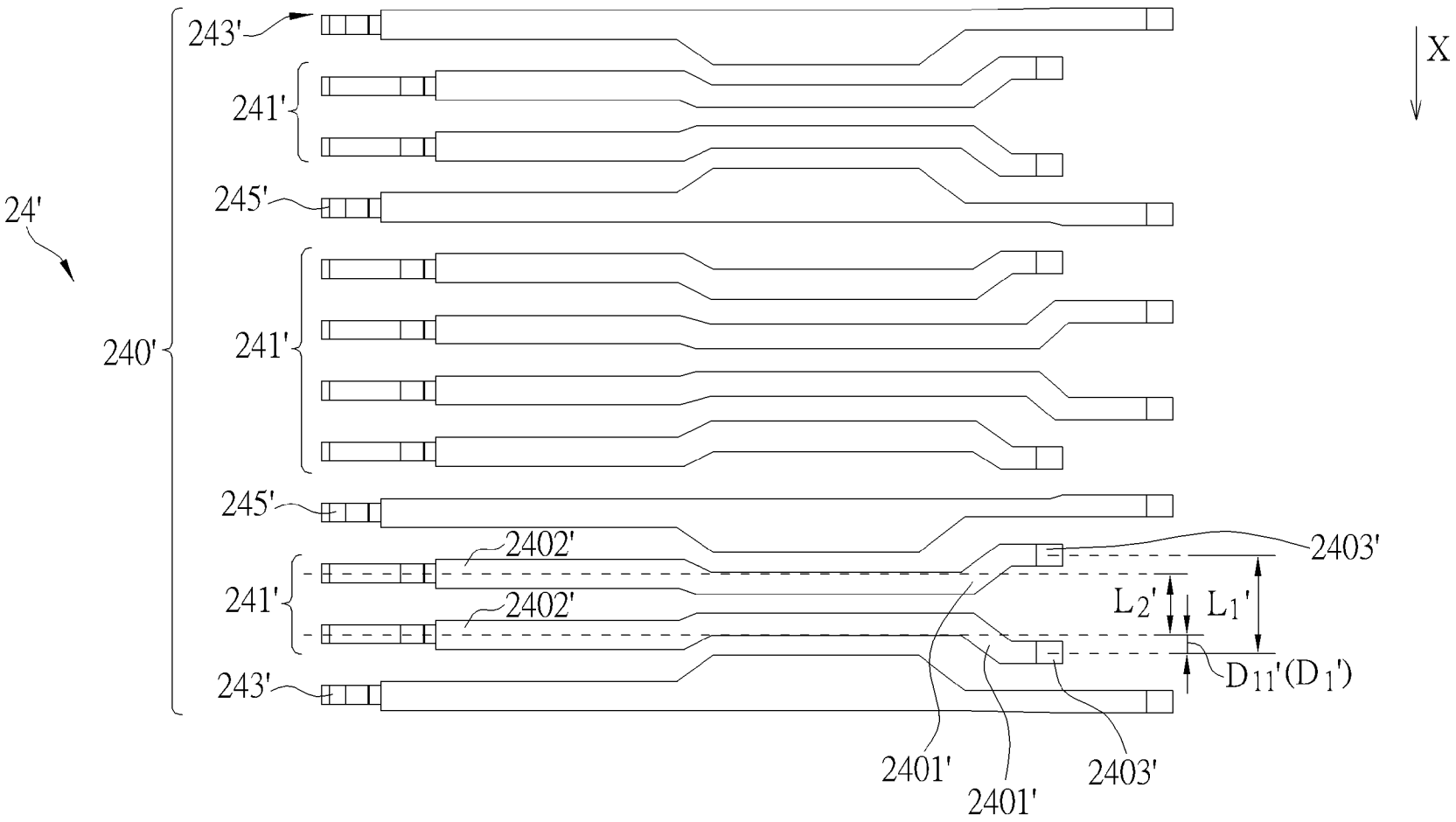
FIG. 8 is a top view diagram of a first blanking contact set of an electrical receptacle connector according to a second embodiment of the present invention.

Please refer to FIG. 8. FIG. 8 is a top view diagram of a first blanking contact set 24' of an electrical receptacle connector 1' according to a second embodiment of the present invention. As shown in FIG. 8, a central axis of a first soldering portion 2403' of a first signal contact 241' is spaced from a central axis of a first contacting portion 2402' of the first signal contact 241' by a first horizontal offset D11' along the plane direction X. A central axis of the first soldering portion 2403' of a first grounding contact 243' coincides with a central axis of the first contacting portion 2402' of the first grounding contact 243' along the plane direction X. A central axis of the first soldering portion 2403' of a first power contact 245' coincides with a central axis of the first contacting portion 2402' of the first power contact 245' along the plane direction X. Therefore, in this embodiment, there is only the first signal contact 241' formed in an expanded arrangement. In other words, the first soldering portions 2403' of the two adjacent signal contacts 241' are spaced by a first pitch L1', and the first contacting portions 2402' of the two adjacent signal contacts 241' are spaced by a second pitch L2'. The first pitch L1' is not equal to a second pitch L2'. Components with denoted in this embodiment identical to those in the aforesaid embodiment have identical structures and functions, and further description is omitted herein for simplicity.

Figure 9:
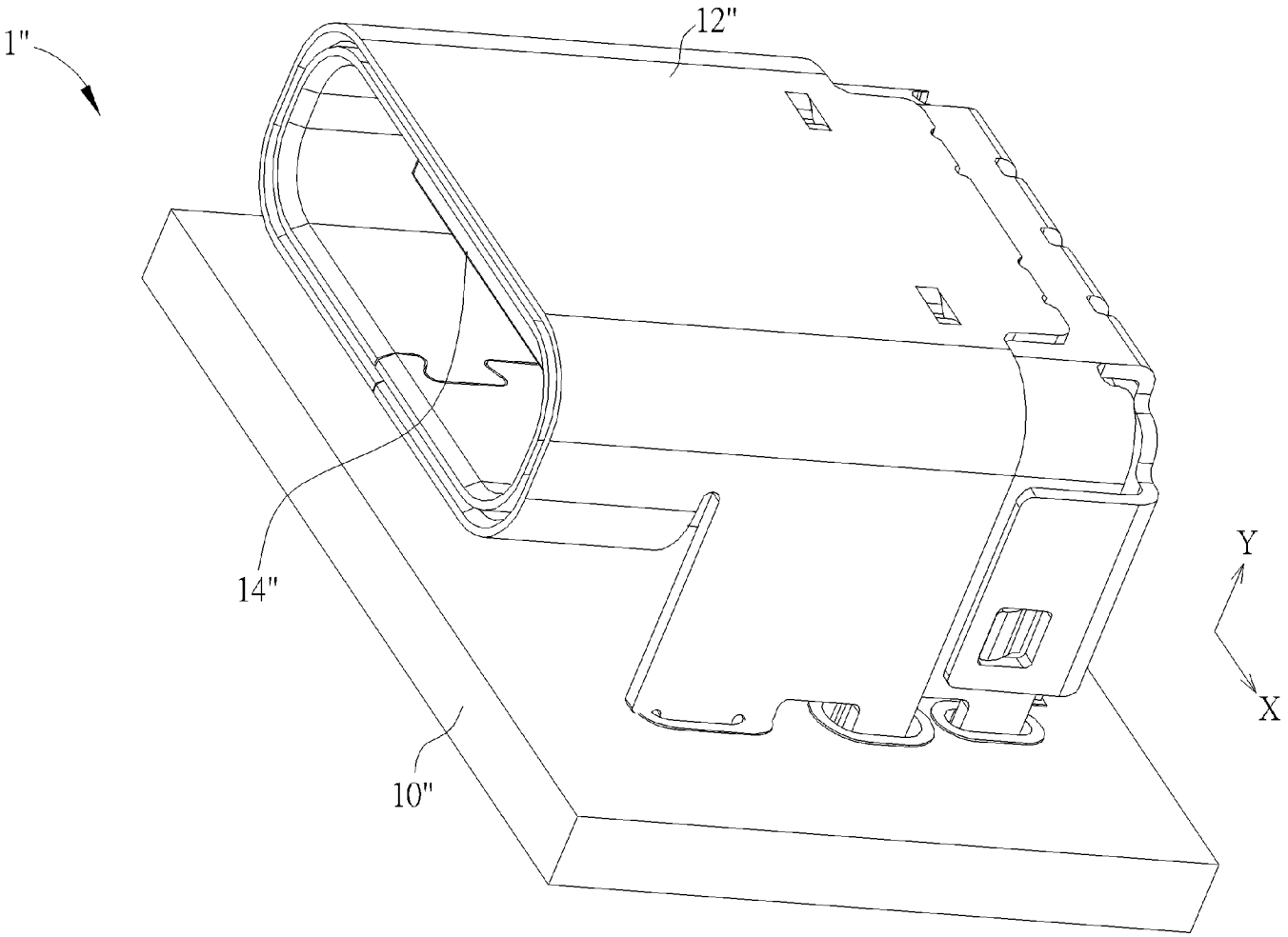
FIG. 9 is a schematic diagram of an electrical receptacle connector according to a third embodiment of the present invention.
Figure 10:
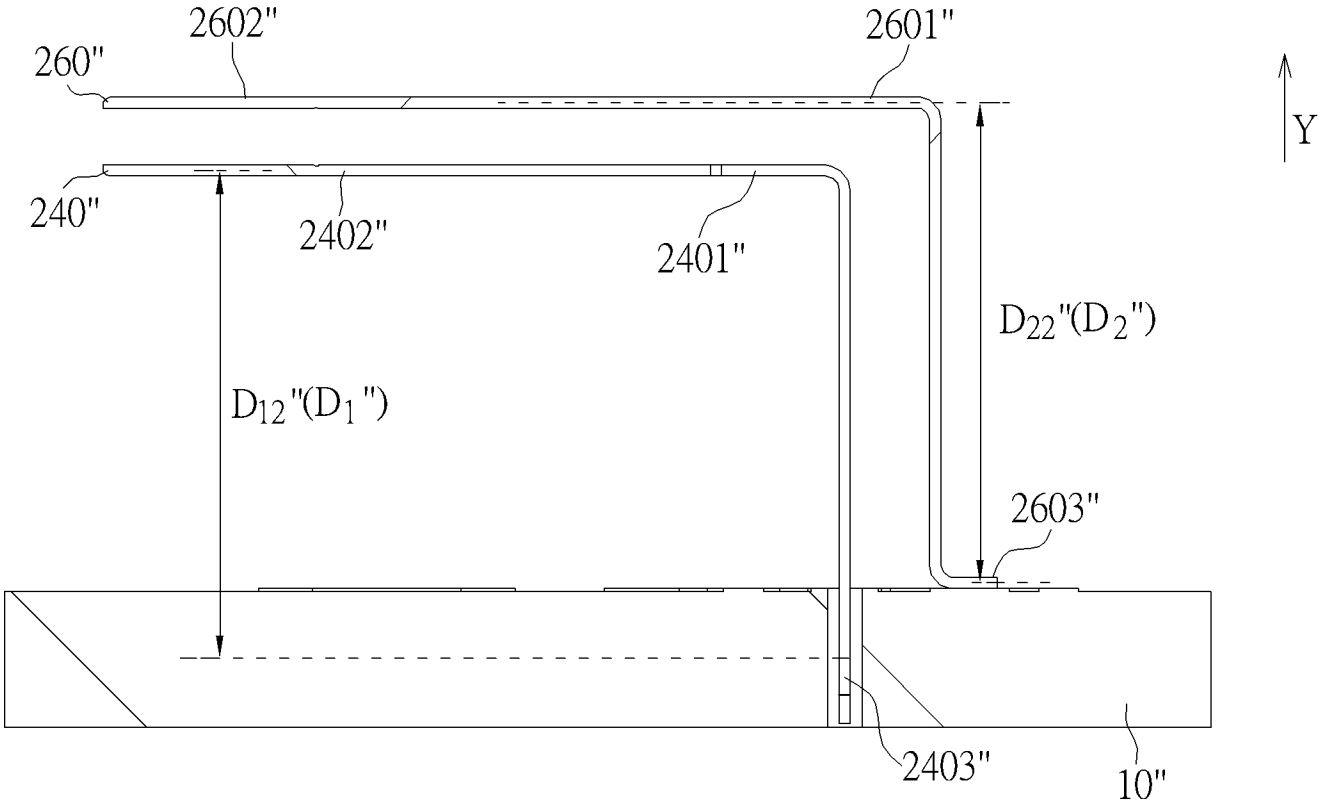
FIG. 10 is a sectional diagram of a first blanking contact, a second blanking contact, and a circuit board according to the third embodiment of the present invention.

Please refer to FIG. 9 and FIG. 10. FIG. 9 is a schematic diagram of an electrical receptacle connector 1" according to a third embodiment of the present invention. FIG. 10 is a sectional diagram of a first blanking contact 240", a second blanking contact 260", and a circuit board 10" of the electrical receptacle connector 1" according to the third embodiment of the present invention. As shown in FIG. 9 and FIG. 10, a central axis of a first soldering portion 2403" of the first blanking contact 240" is spaced from a central axis of a first contacting portion 2402" of the first blanking contact 240" by a first vertical offset D12" along the elevation direction Y, which is longer than the first vertical offset D12 of the first embodiment. A central axis of a second soldering portion 2603" of the second blanking contact 260" is spaced from a central axis of a second contacting portion 2602" of the second blanking contact 260" by a second vertical offset D22" along the elevation direction Y, which is longer than the second vertical offset D22 of the first embodiment. Therefore, bending lengths of a first connecting portion 2401" and a second connecting portion 2601", which is along the elevation direction Y perpendicular to the plane direction X, are longer, so as to align the first soldering portion 2403' and the second soldering portion 2603' with welding locations on the circuit board 10". Components with denoted in this embodiment identical to those in the aforesaid embodiment have identical structures and functions, and further description is omitted herein for simplicity.

In contrast to the prior art, the central axis of the first contacting portion of the present invention is spaced from the central axis of the first soldering portion by the first offset, and the first connecting portion connects the first contacting portion and the first soldering portion. Accordingly, a pitch between the two adjacent first contacting portions is not equal to a pitch between the two adjacent first soldering portions. Therefore, the pitch between the two adjacent first contacting portions can be designed for generally usage of the electrical receptacle connector in accordance with a specification of USB 3.0, and the pitch between the two adjacent first soldering portions can be adjusted according to welding positions on the circuit board. As a result, it achieves better utilization of space, prevents interference between the first soldering portions and reduces cost of manufacture.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electrical receptacle connector adapted for a circuit board, comprising:

a shell;

an insulator comprising a tongue portion and an insulator rear end, the tongue portion being disposed in the shell and comprising a first surface and a second surface;

a conductive structure disposed on the insulator;

a shielding member disposed in the tongue portion; and a first blanking contact set comprising a plurality of first blanking contacts, at least one of the plurality of first blanking contacts comprising:

a first connecting portion combined with the insulator;

a first contacting portion extending from the connecting portion toward the tongue portion and stretching out of the first surface; and a first soldering portion extending from the connecting portion toward the insulator rear end and stretching out of the insulator rear end;

wherein a central axis of the first contacting portion is spaced from a central axis of the first soldering portion by a first offset, and the first connecting portion connect the first contacting portion and the first soldering portion.

2. The electrical receptacle connector of claim 1, wherein the plurality of first blanking contacts are spaced from one another and arranged in parallel along a plate direction, the first offset is decomposed in a first horizontal offset, and the central axis of the first contacting portion is spaced from the central axis of the first soldering portion along the plate direction by the first horizontal offset.

3. The electrical receptacle connector of claim 2, wherein the plurality of first blanking contacts are spaced from one another and arranged in parallel along the plate direction, the first offset is further decomposed in a first vertical offset, and the central axis of the first contacting portion is spaced from the central axis of the first soldering portion along an elevation direction perpendicular to the plate direction by the first vertical offset.

4. The electrical receptacle connector of claim 2, wherein the plurality of first blanking contacts comprises at least one first grounding contact, at least one first signal contact, and at least one first power contact along the plate direction.

5. The electrical receptacle connector of claim 1, further comprising:

a second blanking contact set comprising a plurality of second blanking contacts, at least one of the plurality of second blanking contacts comprising:

a second connecting portion combined with the insulator;

a second contacting portion extending from the second connecting portion toward the tongue portion and stretching out of the second surface; and a second soldering portion extending from the second connecting portion toward the insulator rear end and stretching out of the insulator rear end;

wherein a central axis of the second contacting portion is spaced from a central axis of the second soldering portion by a second offset, and the second connecting portion connect the second contacting portion and the second soldering portion.

6. The electrical receptacle connector of claim 5, wherein the plurality of second blanking contacts are spaced from one another and arranged in parallel along a plate direction, the second offset is decomposed in a second vertical offset, and the central axis of the second contacting portion is spaced from the central axis of the second soldering portion along an elevation direction perpendicular to the plate direction by the second vertical offset.

7. The electrical receptacle connector of claim 6, wherein the plurality of second blanking contacts comprises at least one second grounding contact, at least one second signal contact, and at least one second power contact arranged along the plate direction.

8. The electrical receptacle connector of claim 5, wherein the insulator comprises a first insulator and a second insulator assembled with the first insulator, the first insulator comprises a first upper surface, a first lower surface, a first front end, and a first rear end, the second insulator comprises a second upper surface, a second lower surface, a second front end, and a second rear end, the tongue portion protrudes from the first insulator, the first connecting portion is combined with the first insulator, the second connecting portion is combined with the second insulator, when the second insulator is assembled with the first insulator, the first rear end and the second rear end define the insulator rear end cooperatively, and the first upper surface abuts against the second lower surface.

9. The electrical receptacle connector of claim 8, wherein the conductive structure comprises a first conductive member and a second conductive member, the first conductive member is disposed on the first lower surface, and the second conductive member is disposed on the second upper surface.

10. The electrical receptacle connector of claim 5, wherein each of the first blanking contact set and the second blanking contact set comprises at least two pairs of differential signal contacts, the at least two pairs of differential signal contacts of the first blanking contact set symmetrical to the at least two pairs of differential signal contacts of the second blanking contact set about a front-rear direction of the electrical receptacle connector and coincides with the at least two pairs of differential signal contacts of the second blanking contact set after rotation by 180 degrees.

11. The electrical receptacle connector of claim 5, wherein the two adjacent first soldering portions are spaced by a first pitch, the two adjacent first contacting portions are spaced by a second pitch, the first pitch is not equal to the second pitch, the two adjacent second soldering portions are spaced by a third pitch, the two adjacent second contacting portions are spaced by a fourth pitch, and the third pitch is not equal to the fourth pitch.

12. The electrical receptacle connector of claim 1, wherein the two adjacent first soldering portions are spaced by a first pitch, the two adjacent first contacting portions are spaced by a second pitch, and the first pitch is not equal to the second pitch.

* * * * *